US011660499B2

(12) United States Patent
Kim

(10) Patent No.: US 11,660,499 B2
(45) Date of Patent: May 30, 2023

(54) UPPER LEG AND HIP EXERCISE METHOD AND DEVICE TO PRESERVE KNEE AND ANKLE JOINT WHILE EXERCISING

(71) Applicant: Eun Bee Kim, Chuncheon-si (KR)

(72) Inventor: Eun Bee Kim, Chuncheon-si (KR)

( * ) Notice: Subject to any disclaimer, the term of this patent is extended or adjusted under 35 U.S.C. 154(b) by 523 days.

(21) Appl. No.: 16/575,447

(22) Filed: Sep. 19, 2019

(65) Prior Publication Data

US 2020/0155896 A1 May 21, 2020

Related U.S. Application Data

(63) Continuation-in-part of application No. 15/372,350, filed on Dec. 7, 2016, now Pat. No. 10,625,113.

(30) Foreign Application Priority Data

| | | |
|---|---|---|
| Feb. 15, 2019 | (KR) | 1020190017985 |
| Mar. 5, 2019 | (KR) | 1020190025484 |
| Apr. 9, 2019 | (KR) | 1020190041245 |
| Aug. 4, 2019 | (KR) | 1020190094661 |
| Aug. 9, 2019 | (KR) | 1020190097870 |
| Aug. 31, 2019 | (KR) | 1020190107818 |
| Aug. 31, 2019 | (KR) | 1020190107819 |
| Sep. 9, 2019 | (KR) | 1020190111155 |
| Sep. 9, 2019 | (KR) | 1020190111516 |

(51) Int. Cl.

| | |
|---|---|
| ***A63B 23/04*** | (2006.01) |
| ***A63B 21/04*** | (2006.01) |
| ***A63B 21/055*** | (2006.01) |
| ***A63B 21/062*** | (2006.01) |
| ***A63B 21/00*** | (2006.01) |

(Continued)

(52) U.S. Cl.

CPC ..... *A63B 23/0476* (2013.01); *A63B 21/0435* (2013.01); *A63B 21/0552* (2013.01); *A63B 21/0628* (2015.10); *A63B 21/4034* (2015.10); *A63B 21/4035* (2015.10); *A63B 22/0046* (2013.01); *A63B 22/0605* (2013.01); *A63B 2208/0233* (2013.01); *A63B 2225/093* (2013.01)

(58) Field of Classification Search

CPC ..... A63B 21/0628; A63B 21/4034; A63B 21/4035; A63B 21/0552; A63B 21/0626; A63B 22/0046; A63B 22/0605; A63B 2208/0233; A63B 2225/093

See application file for complete search history.

(56) References Cited

U.S. PATENT DOCUMENTS 2,855,199 A * 10/1958 Noland ..... A63B 23/0494 601/24
4,600,189 A * 7/1986 Olschansky ..... A63B 21/4047 482/142

(Continued)

*Primary Examiner* — Joshua T Kennedy

(57) ABSTRACT

The present invention includes an arm; a leg pad; a long rectangle shaped seat; a seat angle fixing unit on the seat, for adjusting the angle between the seat and the leg pad (when viewed from above) according to his/her purpose so that the seat can be adjusted to be perpendicular or parallel to the leg pad when viewed from above; and thus the to the user is allowed to move the exercising leg of the user to the back of the user or perform a motion for stretching his/her back straight from a starting pose at which the user lie down on his/her back placed on the seat, wherein the leg pad is placed above the user's pelvis.

2 Claims, 11 Drawing Sheets

(51) Int. Cl.
*A63B 22/00* (2006.01)
*A63B 22/06* (2006.01)

(56) References Cited

U.S. PATENT DOCUMENTS 4,621,807 A * 11/1986 Stramer ..... A63B 21/06
482/100
4,834,396 A * 5/1989 Schnell ..... A63B 21/4047
482/142
4,854,578 A 8/1989 Fulks
4,893,812 A * 1/1990 Dawson, Jr. ..... A63B 21/154
482/94
5,039,092 A * 8/1991 Olschansky ..... A63B 21/4047
482/130
5,074,551 A * 12/1991 Olschansky ..... A63B 21/151
482/130
5,308,304 A * 5/1994 Habing ..... A63B 21/0628
482/99
5,360,383 A 11/1994 Boren
5,800,323 A * 9/1998 Ansel ..... A63B 21/169
482/904
7,476,186 B1 * 1/2009 Steffee ..... A63B 21/0628
482/145
7,537,551 B2 * 5/2009 Steffee ..... A63B 21/0628
482/137
2016/0354627 A1 * 12/2016 Cygan ..... A63B 23/03508
2020/0179750 A1 * 6/2020 Carter ..... A63B 21/4035

* cited by examiner

UPPER LEG AND HIP EXERCISE METHOD AND DEVICE TO PRESERVE KNEE AND ANKLE JOINT WHILE EXERCISING

CROSS-REFERENCE TO RELATED APPLICATION

This application is a continuation-in-part of, U.S. application Ser. No. 15/373,350, which entered the U.S. on Dec. 7, 2016, from KR application No. 10-2016-0164260, filed on Dec. 5, 2016, which is patented on Feb. 20, 2019, in the KR Intellectual Property Office. This application claims the benefit of priority and incorporates by reference, KR Application No. 10-2019-0025484, filed on Mar. 4, 2019; KR Application No. 10-2019-0017985, filed on Feb. 15, 2019, which are patented in KR Intellectual Property Office, and are divisions of KR application No. 10-2016-0164260, filed on Dec. 5, 2016, in the KR Intellectual Property Office, which entered the U.S. on Dec. 7, 2016. This application claims the benefit of priority and incorporates by reference, U.S. application Ser. No. 16/543,613, filed on Aug. 18, 2019; U.S. application Ser. No. 16/543,631, filed on Aug. 19, 2019; U.S. application Ser. No. 16/554,703, filed on Aug. 29, 2019, which are divisions of U.S. application Ser. No. 15/372,350, filed on Dec. 7, 2016; Korean Application No. 10-2019-0041101, filed on Apr. 8, 2019; Korean Application No. 10-2019-0041245, filed on Apr. 9, 2019; Korean Application No. 10-2019-0094661, filed on Aug. 4, 2019; Korean Application No. 10-2019-0097870, filed on Aug. 9, 2019; Korean Application No. 10-2019-0107818 entitled Leg and hip exercise device, filed on Aug. 31, 2019; Korean Application No. 10-2019-0107819, filed on Aug. 31, 2019; Korean Application No. 10-2019-0111516, filed on Sep. 9, 2019; Korean Application No. 10-2019-0111155, filed on Sep. 9, 2019; Korean Application No. 10-2019-0111797, filed on Sep. 9, 2019, Korean Application No. 10-2019-0116635, filed on Sep. 23, 2019, in the Korean Intellectual Property Office. The present application has the same inventor as the aforementioned applications.

FIELD OF THE INVENTION

The present disclosure relates to an exercise method and an exercise device for performing exercises suitable to strengthen thigh and hip muscles while protecting the knee and ankle joints such as a leg press machine, a total hip machine, a hip abductor machine, a leg extension machine, a leg curl machine, a stationary bicycle, and more particularly, to an exercise method and an exercise device for strengthening thigh and hip muscles while protecting knee and ankle joints by enabling a user to locate a hip and a thigh of a leg of two legs of the user that is not exercising on a seat and locate a lower end of an arm on the other leg of two legs of the user that is exercising and move the exercising leg backward from an exercise starting position where the exercising leg is pulled toward the user's chest such that the user's exercising leg moves during exercises and the user flexes the hip of the exercising leg.

To this end, the exercise device according to the present disclosure includes a seat configured to support a thigh and a hip of a leg of two legs of the user that is not exercising in the sitting or lying position and the arm rotatably attached within a radius of 20 cm from the user's pelvis in a sagittal plane, wherein an end of the arm is rotatably placed on the user's leg of a two that is exercising.

The exercise device allows the user to exercise the thigh and gluteal muscles while protecting knee and ankle joints of the leg that is not exercising by providing a seat separately from the leg pad when viewed from above, so that the device enables the exercising leg of the user to move to the back of the user from a starting pose at which the hip and the thigh of the leg that is not exercising are placed on the seat and the other leg is placed on the leg pad and pulled to the chest of the user.

DESCRIPTION OF RELATED ART

Thigh and hip muscles account for more than a third of all muscles in our body. Building thigh and hip muscles may reduce the risk of diabetes, etc., may prevent obesity, and may promote health after middle age, and may also help to improve the physical fitness and sport ability of athletes.

However, exercises for strengthening thigh and hip muscles apply a load to ankle and knee joints, and thus knee osteoarthritis and chondromalacia are common among people who do strength training. Also, it is difficult for people with weak knees and ankle joints such as elders or obese people to perform exercises for strengthening thigh and hip muscles. Accordingly, there is a demand for an exercise device for training thigh and hip muscles without adding stress to the knees and joints. In general, a user performs an exercise for strengthening thigh and hip muscles by pulling his/her legs toward the chest and pushing them outward with the pelvis as an axis, as shown in FIG. 1. Also, in a general bicycle, since a high hip motion range is limited to a rotation radius of a crank connected to a bicycle pedal, as shown in FIG. 2, the user's exercise is repeatedly performed only in a relatively small space when compared to the high hip motion range, and thus exercise efficiency in utilization of thigh and hip muscles is limited.

However, existing exercise methods and exercise devices may damage the knees and ankle joints because a load is directly transmitted to the ankles and knees, and thus it is not suitable for people with weak knees and ankle joints to use the existing exercise methods and exercise devices.

Accordingly, the present disclosure is configured to reduce a force transmitted to the knees and ankles by enabling a user to locate a foot plate or a foot pad of an exercise machine connected to a weight on his/her leg and pull his/her legs toward the chest and push them backward in a sitting, lying, or prone position.

When the exercise device according to an embodiment of the present disclosure is used, the user's thigh and hip muscles are enabled to perform lateral rotation and adduction as well as extension of the hip joints and extension of the knee joints and a two axes motion.

SUMMARY

In general, a user performs an exercise for strengthening thigh and hip muscles by pulling the legs toward the chest and pushing them outward with the pelvis as an axis, as shown in FIG. 1. Also, in a general bicycle, since a high hip motion range is limited to a rotation radius of a crank connected to a bicycle pedal, as shown in FIG. 2, the user's exercise is repeatedly performed only in a relatively small space when compared to the high hip motion range, and thus exercise efficiency in utilization of thigh and hip muscles is limited.

The exercise device according to an embodiment of the present invention includes: an arm pivotably connected to the frame and rotatable wherein the arm comprises an arm pivot axis aligned with a user's hip joint; a leg pad pivotably connected to a lower end of the arm and configured to contact the user's leg during use, a handle connected to a lower end of the seat or to the frame and extending therefrom; an arm starting region fixing unit which is provided to fix an exercise starting section; an arm length fixing unit for adjusting the length of the arm; a seat which is configured in correspondence to a hip and a thigh of a leg of two legs of a user so as to support the hip and the thigh of the leg that is not exercising and not to support the hip nor the thigh of the other leg of the user, and thus the seat is separated from the leg pad when viewed from above and is configured to enable the exercising leg of the user to move to the back of the user from a starting pose at which the hip and the thigh of the leg that is not exercising is placed on the seat and the exercising leg is placed on the leg pad and pulled to the chest of the user. Preferably, a leg pad may be configured to contact the user's thigh during use to protect the user's knee and ankle joints while exercising. Also, the exercise method and the exercise device improve the exercise effect of strengthening thigh and hip muscles by adding a hip joint motion direction, axis, and knee joint motion.

DETAILED DESCRIPTION OF THE PREFERRED EMBODIMENTS

In the following description, well-known elements are not described in detail since they would obscure the invention with unnecessary detail. Various modifications and alternatives may be made in the present disclosure, and embodiments will herein be described in detail. It should be understood, however, that there is no intent to limit embodiments to the particular forms disclosed, but on the contrary, embodiments are to cover all modifications, equivalents, and alternatives falling within the scope of the present disclosure. The terminology used herein is for the purpose of describing embodiments only and is not intended to be limiting of embodiments. It will be further understood that the terms "comprises", "comprising", "includes", and/or "including", when used herein, specify the presence of stated features, integers, elements, components, and/or groups thereof but do not preclude the presence or addition of one or more other features, integers, elements, components, and/or groups thereof.

Embodiments of an exercise for strengthening thigh and hip muscles of the present disclosure for accomplishing the objectives will now be described with reference to the attached drawings.

Figure 1:
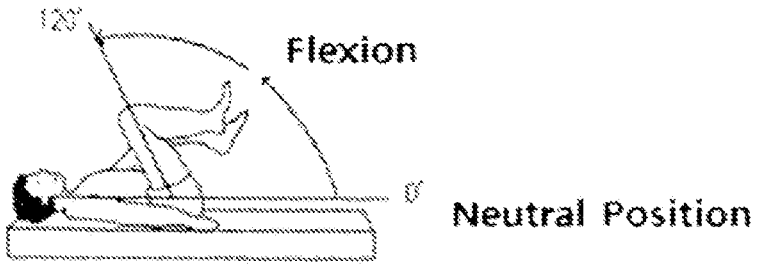
FIG. 1 is a view illustrating a general hip joint motion range in a sagittal plane.
Figure 2:
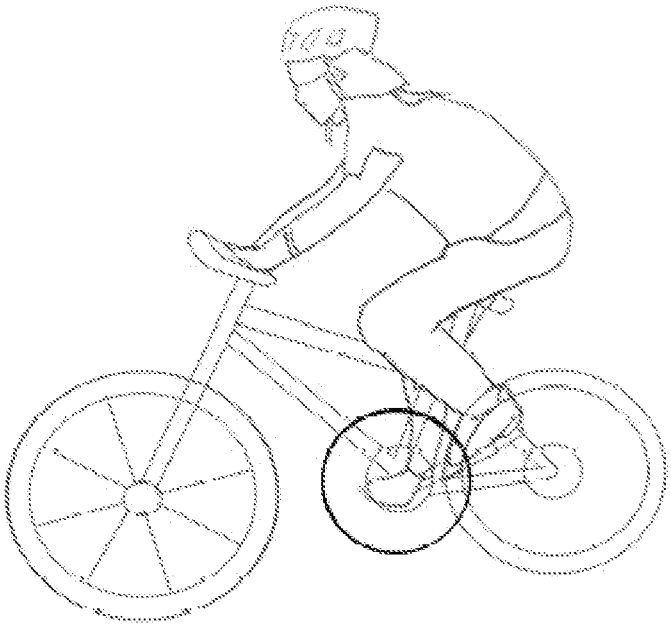
FIG. 2 is a view illustrating a motion range of a bicycle crank.
Figure 3:
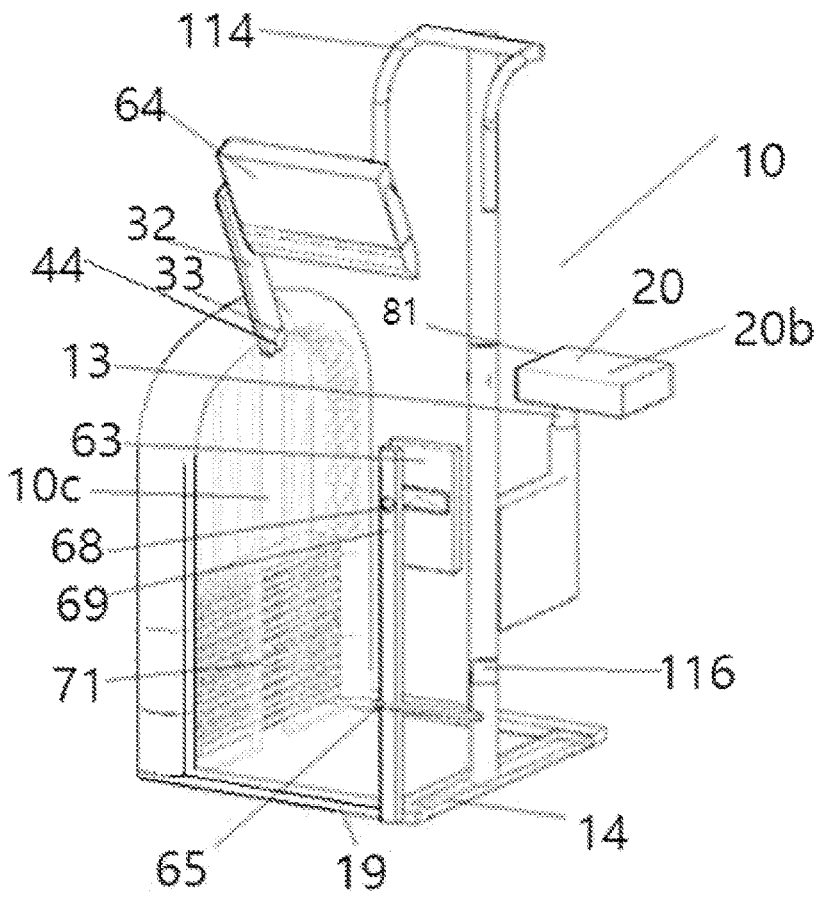
FIG. 3 is a view for describing an exercise device according to an embodiment of the present invention to which the seat is attached to be separated from the leg pad when viewed from above, in order to perform an extension operation of the user's right leg when the user is sitting on the seat with the left leg and the left hip of the user.
Figure 16:
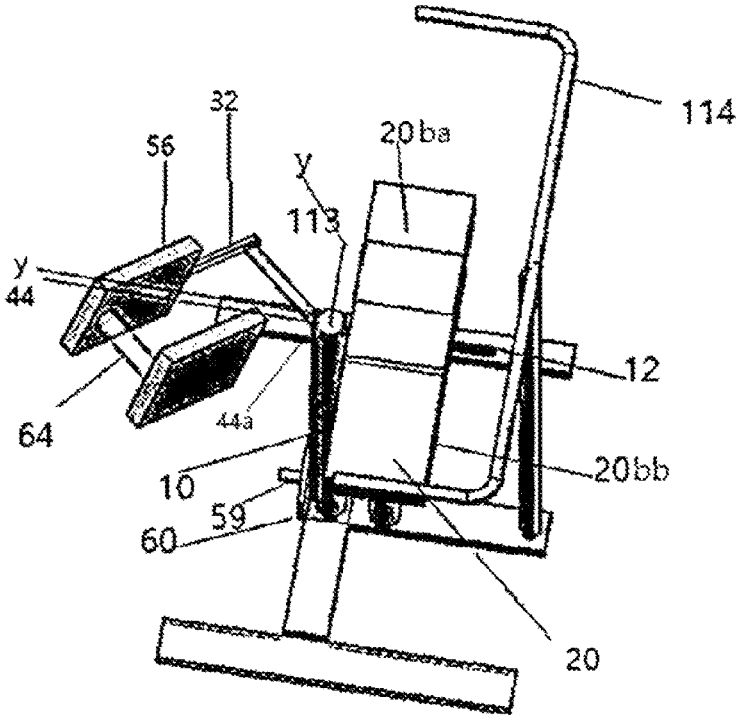
FIG. 16 is a diagram for describing the exercise device according to an embodiment of the present invention, to which the seat is attached to be separated from the leg pad when viewed from above, and it is adjusted to perform an extension and abduction operation of the user's right leg when the user is sitting on the seat with the left leg and the left hip of the user.
Figure 18:
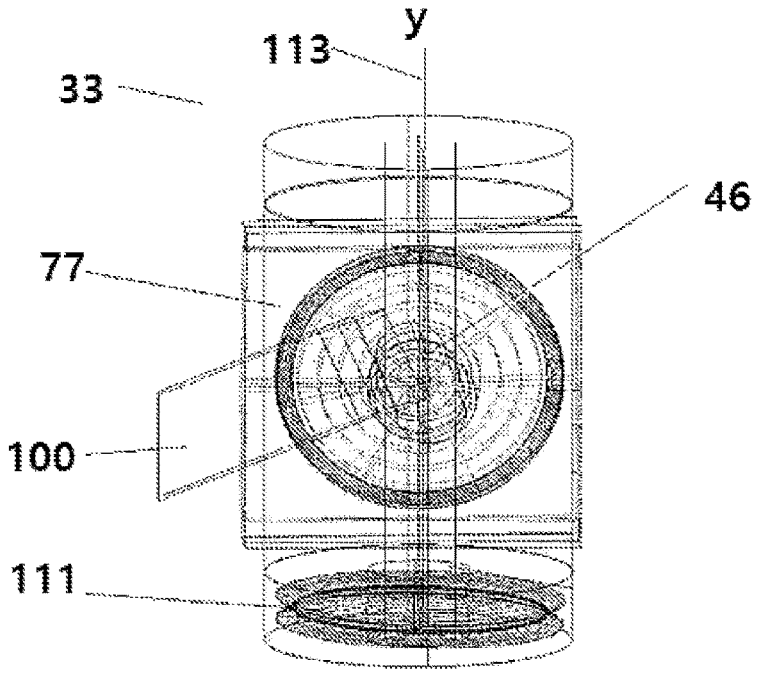
FIG. 18 is an exploded perspective view of the two axis mechanism of FIG. 17.
Figure 19:
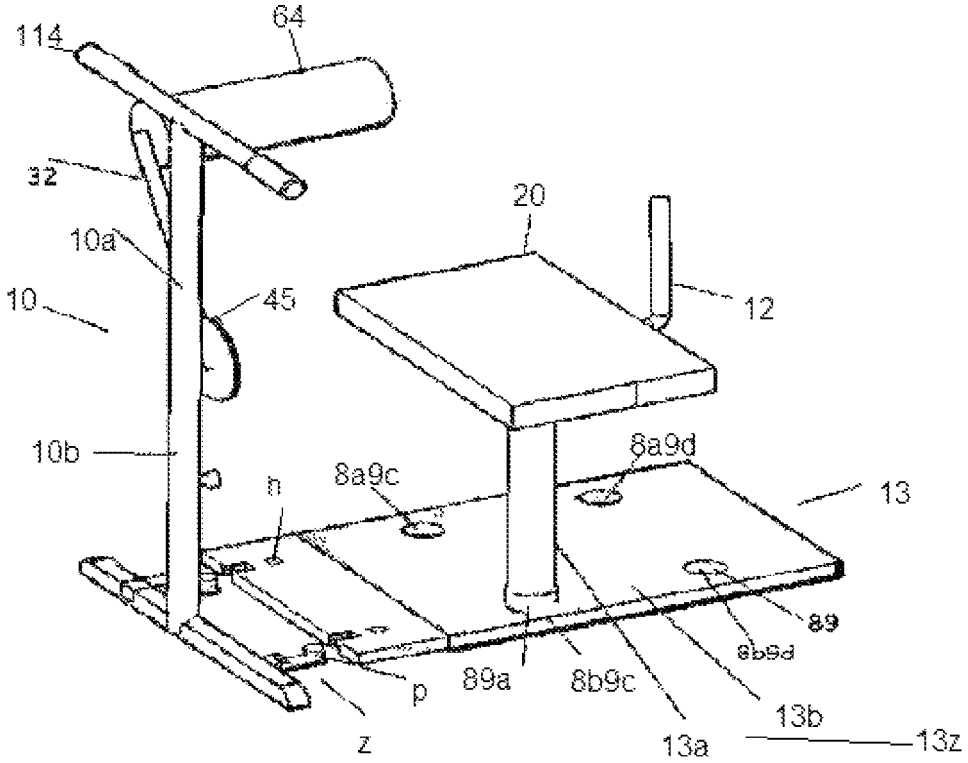
FIG. 19 is a diagram for describing the exercise device according to an embodiment of the present invention, the diagram showing a state in which the seat is adjusted to be unseparated from the leg pad when viewed from above, and the diagram illustrates a seat strut attachment unit for attaching the seat strut to the arm strut or separating the seat strut from the arm strut on the user's purpose.

FIGS. 1 and 2 are views respectively illustrating a general hip joint motion range in a sagittal plane and a motion range of a bicycle crank. FIG. 3, through FIG. 16 are views in which exercise devices according to an embodiment of the present disclosure include: an arm 32 pivotably connected to the frame 10 and rotatable wherein the arm comprises an arm pivot axis 44 aligned with a user's hip joint; a handle connected to a lower end of the seat 20 or to the frame 10 and extending therefrom; a seat 20 which is provided in correspondence to a hip and a thigh of a leg of two legs of a user that is not exercising so as to support the hip and the thigh of the leg that is not exercising and not to support the hip nor the thigh of the other leg of the user, and thus the seat 20 is separated from the leg pad 64 when viewed from above 20*b*. The invention is configured to enable the exercising leg of the user to move to the back of the user from a starting pose at which the hip and the thigh of the leg that is not exercising is placed on the seat 20 and the exercising leg is placed on the leg pad 56 and pulled to the chest of the user. FIGS. 6, 11, 12, 13 are views in which the seat is provided separately from the leg pad 64 when viewed from above 20*b*, and adjusted by the user with a seat angle fixing unit, a seat location fixing unit or an arm location fixing unit, to be unseparated from the leg pad 64 when viewed from above 20*a*, so that, the user can perform other exercises additionally according to the purpose. FIG. 16, 17 are views illustrating a two axes mechanism 44*a* which is attached to an exercise device according to an embodiment of the present invention. FIGS. 18, 19 are partial views illustrating the two axes mechanism 44*a* of FIGS. 16, 17 which is provided on the arm 32. A detailed configuration is illustrated and will be described in detail.

FIG. 3 describes an exercise device according to an embodiment of the present invention, in which an arm 32 is rotatably connected to the resistive force strut of the frame 10*c*, and a leg pad 64, an arm axis 44, a seat 20, an arm connector 33, cross strut of the frame 14, a handle 114, an arm pivot axis 44, a rear ground support member of the frame 19, a seat strut of the frame 13, knee support for supporting a leg of two legs of the user that is not exercising 63, knee support height fix unit 69, knee support right/left adjustment unit 68, foot rest 65, a set of weight stack 71, a seat angle fixing unit 116 which is on the frame are attached according to an embodiment of the present invention and shows a state in which a user adjusted a seat to be perpendicular to a leg pad when viewed above 20*b* enabling a user to locate a hip and a thigh of a right leg of two legs of the user that is not exercising and set the arm starting region fixing unit 45 to the right side when viewed from above in order to perform a press down and kick back motion of the left leg of the user.

Figure 4:
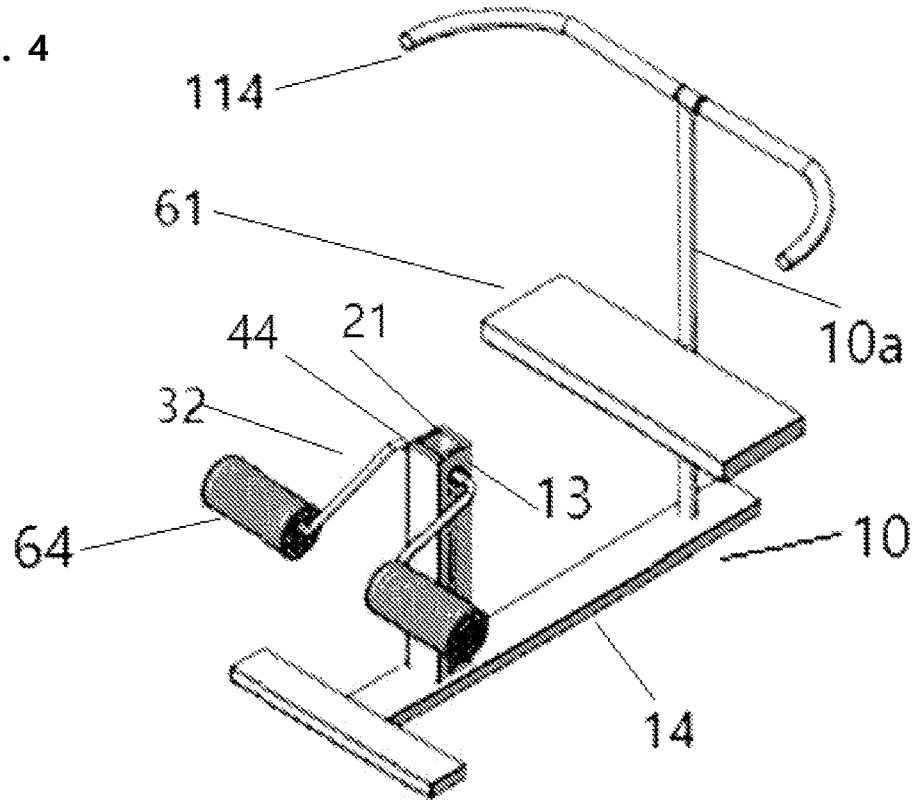
FIG. 4 is a diagram for describing an exercise device according to an embodiment of the present invention, the diagram showing a rectangular shaped seat base which is provided as a seat angle fixing unit.

FIG. 4 describes an exercise device according to an embodiment of the present invention, in which an arm is 32 rotatably connected to the seat strut of the frame 13, and a leg pad 64, an arm axis 44, a seat 20, a cross strut of the frame 14, a handle 114, a foot support for supporting a foot of two feet of the user that is not exercising 61, a handle strut of the frame 10*a*, a seat strut of the frame 13, an elastic ban 75 as a resistive force, and shows a state in which a seat base 21 having a rectangular shape are provided, such that a user may attach the seat at a 90 degree, 180 degree, 270 degree, or 360 degree angle when viewed from above according to purposes.

Figure 5:
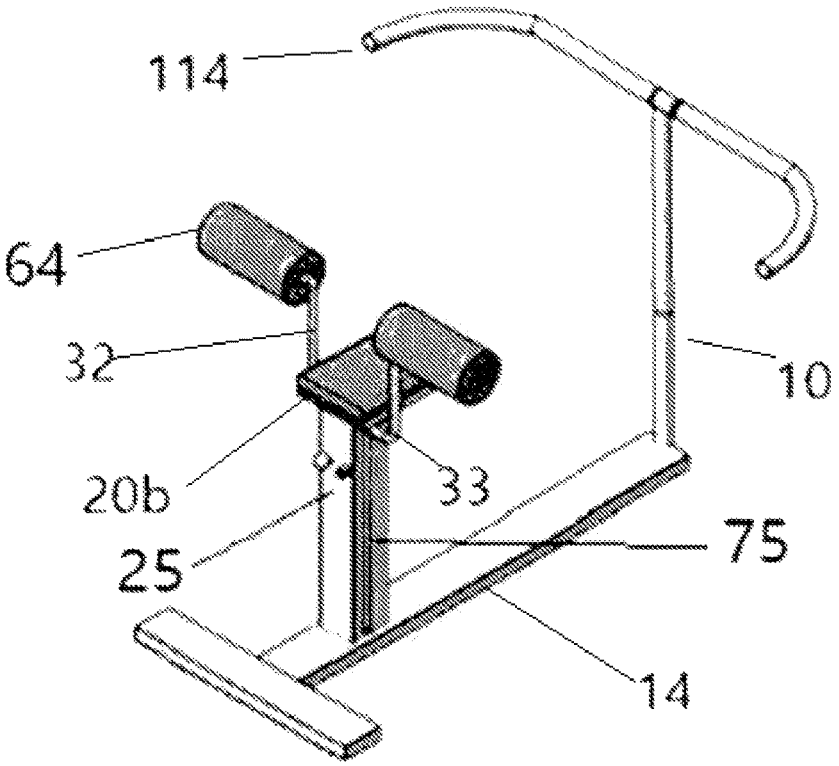
FIG. 5 is a view for describing the exercise device according to an embodiment of the present invention to which the seat is attached to be separated from the leg pad when viewed from above, in order to perform an extension operation of the user's right leg when the user is sitting on the seat with the left leg and the left hip of the user or vice versa.

FIG. 5 describes an exercise device according to an embodiment of the present invention, in which an arm 32 is rotatably connected to the seat strut of the frame 13, and a leg pad 64, a seat in a state perpendicular to the leg pad 20*b*, a cross strut of the frame 14, a handle 114, a frame 10, an elastic band 75 as a resistive force, are provided and shows a state in which the angle of the seat is adjusted to 0 or 360 degrees around the seat support when viewed from above 20*b*, such that a user's leg may perform an hip extension operation.

Figure 6:
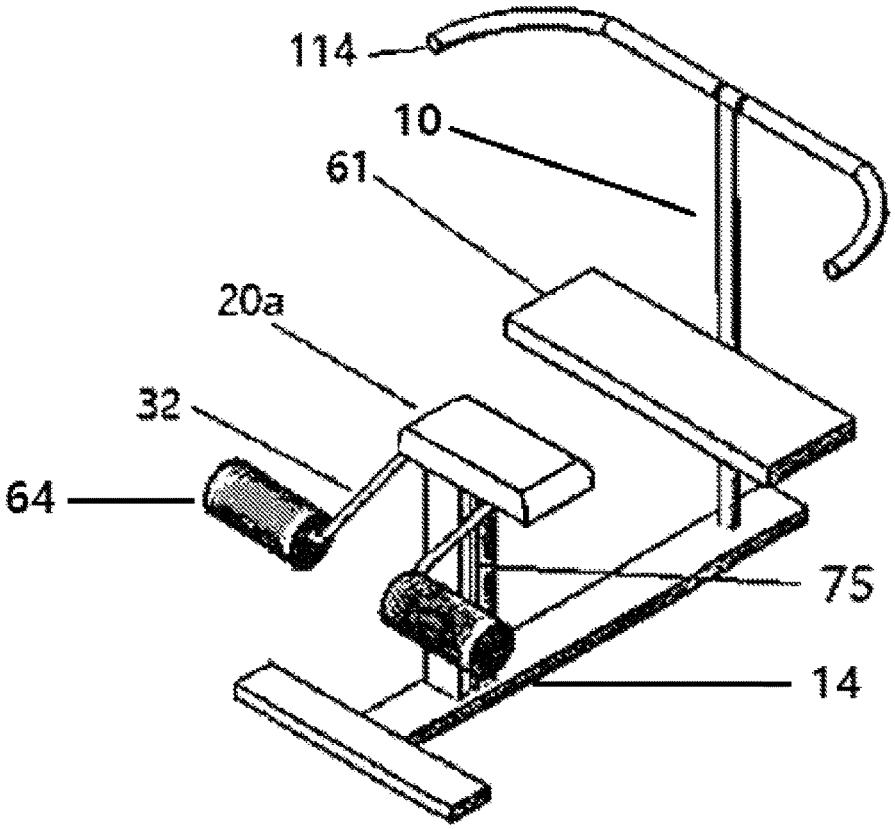
FIG. 6 is a diagram for describing the exercise device according to an embodiment of the present invention, the diagram showing a state in which the seat is adjusted to be unseparated from the leg pad when viewed from above, in order to perform adduction of the right leg when the user is sitting on the seat with the left leg and the left hip of the user.

FIG. 6 describes an exercise device according to an embodiment of the present invention, in which an arm 32 is rotatably connected to the seat strut of the frame 13, and a leg pad 64, a seat in a state parallel to the leg pad 20*a*, a cross strut of the frame 14, a handle 114, a frame 10, a foot support for supporting a foot of two feet of the user that is not exercising 61, an elastic band 75 as a resistive force, a seat holder 25 for holding the seat 20*b* are provided, and shows a state in which the seat is attached to a seat base and the angle of the seat is adjusted to 20*a* when viewed from above 20*a* to enable a user's legs to perform abduction and adduction.

Figure 7:
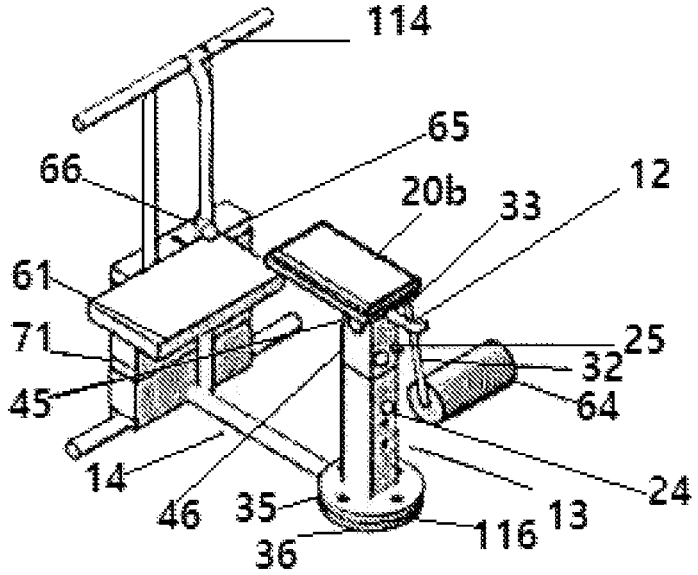
FIG. 7 is a view for describing the exercise device according to an embodiment of the present disclosure to which the seat is attached to be separated from the leg pad when the arm is rotated to be in the center and viewed from above, in order to perform an extension operation of the user's right leg when the user is sitting on the seat with the left leg and the left hip of the user.

FIG. 7 describes an exercise device according to an embodiment of the present invention, in which an arm 32 is rotatably connected to the seat strut of the frame 13, and a leg pad 64, a seat in a state perpendicular to the leg pad 20*b*, a cross strut of the frame 14, a handle 114, a frame 10, a leg pad 64, a foot support for supporting a foot of two feet of the user that is not exercising 61, a set of weight stack 71 as a resistive force, a foot support fixing unit 65 capable of changing the position of the foot support to the left or right. A foot support height fixing unit 66 that may adjust the height of the foot support height, a seat strut of a frame 13, an arm starting region fixing unit 45, a roller for arm starting fixing unit 45, a seat handle 12, a seat holder 25 for holding the seat 20*b*, a seat angle fixing unit 116, a roller for seat angle fixing unit 35, a roller base for sit angle fixing unit 36 are provided and shows a state in which the seat angle fixing unit for adjusting the angle between the seat and frame is adjusted to enable the user to perform a press down and kick back motion of the right leg.

Figure 8:
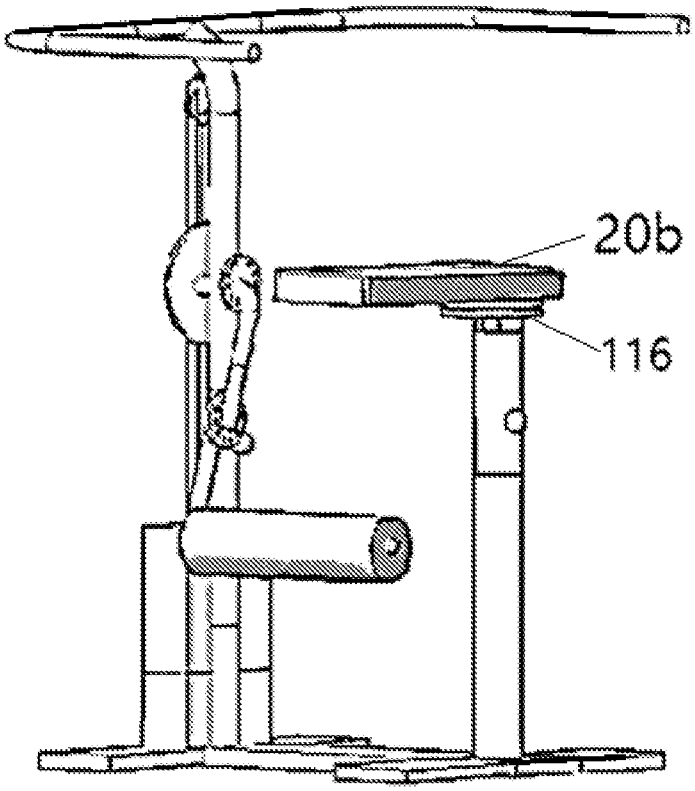
FIG. 8 is a diagram for describing the exercise device according to an embodiment of the present invention, to which the seat is attached to be separated from the leg pad when viewed from above, in order to perform an extension operation of the user's right leg when the user is sitting on the seat with the left leg and the left hip of the user.

FIG. 8 describes an exercise device according to an embodiment of the present invention, to which the seat is attached to be separated from the leg pad when viewed from above 20*b*, and a seat angle fixing unit 116 is attached under the seat, and adjusted to perform an extension operation of the user's right leg when the user is sitting on the seat with the left leg and the left hip of the user.

Figure 9:
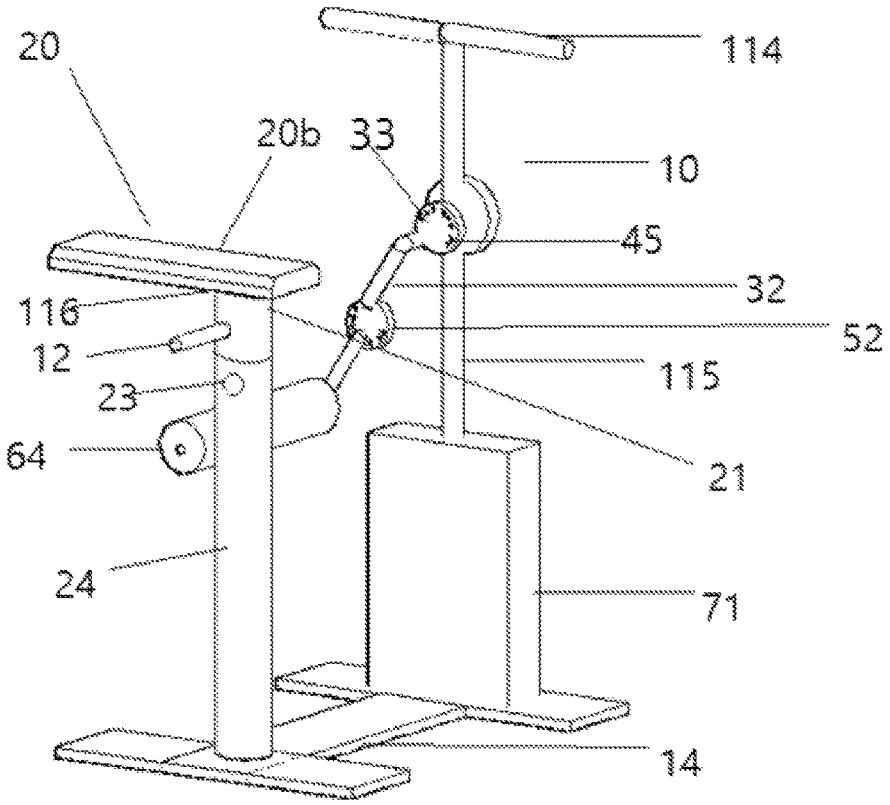
FIG. 9 is a diagram for describing the exercise device according to an embodiment of the present invention, to which the seat is attached to be separated from the leg pad when viewed from above, in order to perform an extension operation of the user's right leg when the user is sitting on the seat with the left leg and the left hip of the user.

FIG. 9 describes a state in which a seat handle 12, a handle 114, a frame 10, a seat 20, an arm 32, an arm length fixing unit 52, an arm angle fixing unit 116, a seat height fixing unit 24, a seat height fixing pin 23, a leg pad 64, a seat base 21, an arm starting region fixing unit 45 on the arm, an arm connector 33 for connecting the arm to the frame, an arm axis height fixing unit 115, a set of weight stack 71, are attached.

Figure 10:
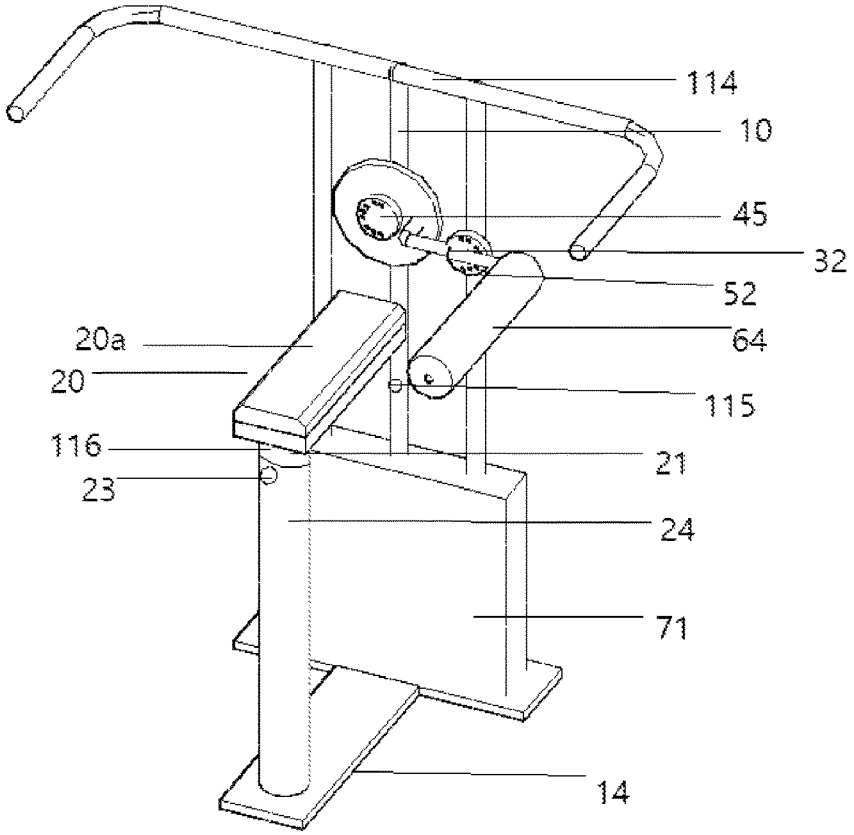
FIG. 10 is a diagram for describing the exercise device according to an embodiment of the present invention, the diagram showing a state in which the seat is adjusted to be unseparated from the leg pad when viewed from above, in order to induct the user's right leg when the user is sitting on the seat with the left leg and the left hip of the user.

FIG. 10 describes a state in which a seat handle 12, a handle 114, a frame 10, a seat 20, an arm 32, an arm length fixing unit 52, an arm angle fixing unit 116, a seat height fixing unit 24, a cross strut of the frame 14, a handle 114, a seat height fixing pin 23, a seat base 21, a leg pad 64, an arm starting region fixing unit 45, an arm connector 33 for connecting the arm to the frame, an arm axis height fixing unit 115, a set of weight stack 71, are attached according to an embodiment of the present invention and describes a state in which the seat angle fixing unit for adjusting the angle between the seat and the leg pad is attached to be perpendicular, so that, it enables the user to induct the user's right leg.

Figure 11:
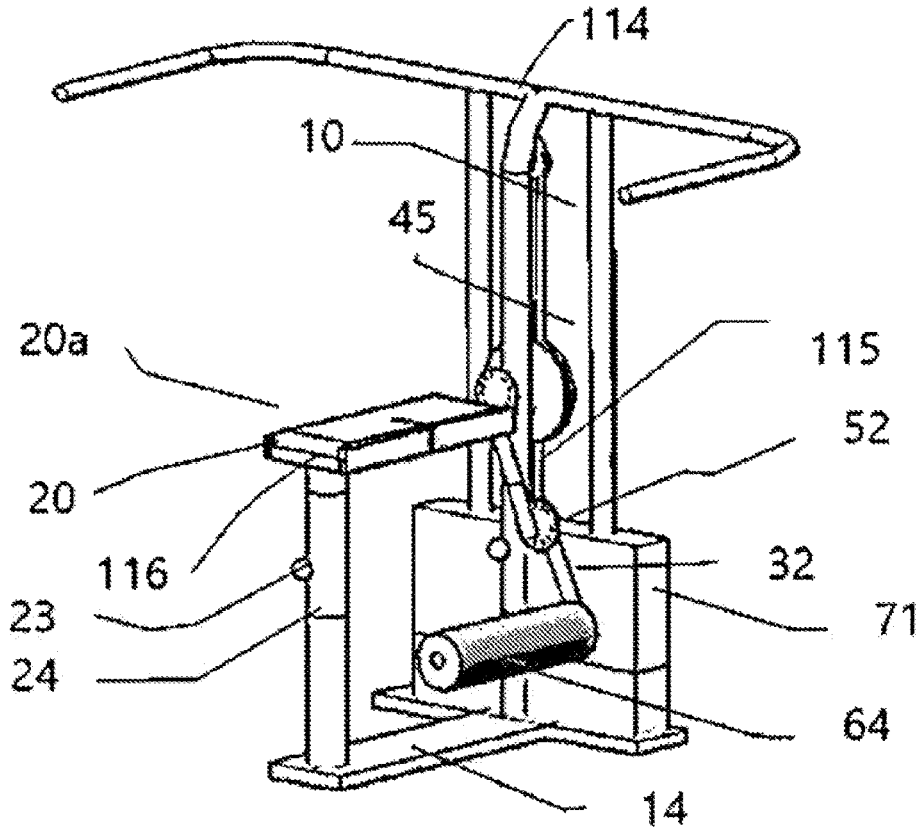
FIG. 11 is a diagram for describing the exercise device according to an embodiment of the present invention, the diagram showing a state in which the seat is adjusted to be unseparated from the leg pad when viewed from above, in order to lie down on his/her back placed on the seat, perform a motion for stretching his/her back straight from a starting pose at which the user places the leg pad above the pelvis, bends his/her knees to put feet on the ground, and bend his/her back to 90 degrees.

FIG. 11 describes a state in which a seat handle 12, a handle 114, a frame 10, a seat 20, an arm 32, an arm length fixing unit 52, an arm angle fixing unit 116, a seat height fixing unit 24, a cross strut of the frame 14, a leg pad 64, a handle 114, a seat height fixing pin 23, a seat base 21, an arm starting region fixing unit 45, an arm connector 33 for connecting the arm to the frame, an arm axis height fixing unit 115, a set of weight stack 71, are attached according to an embodiment of the present invention and describes a state in which the seat angle fixing unit for adjusting the angle between the seat and the leg pad is attached to be parallel to each other, so that, it enables the user to lie down on his/her back placed on the seat, perform a motion for stretching his/her back straight from a starting pose at which the user places the leg pad above the pelvis, bends his/her knees to put feet on the ground, and bend his/her back to 90 degrees; or abduct the user's right leg.

Figure 12:
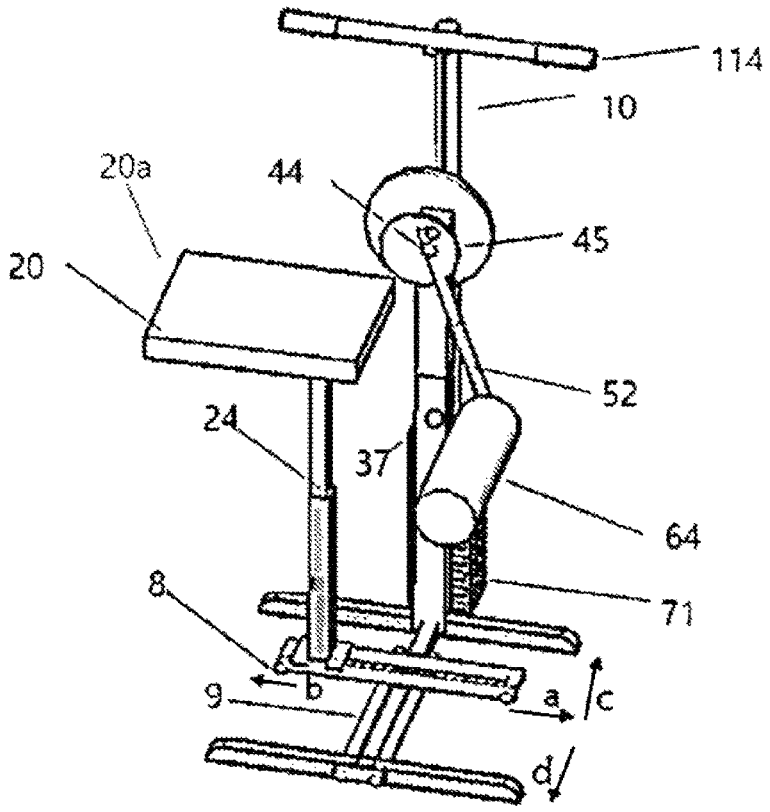
FIG. 12 is a diagram for describing the exercise device according to an embodiment of the present invention, the diagram showing a state in which the seat is attached to be separated from the leg pad when the arm is rotated to be in the center and viewed from above, in order to sit on the seat with both of the user's hip and thigh and perform leg extension exercises.

FIG. 12 describes a state in which a handle 114, a frame 10, a seat 20, a seat height fixing unit 24, a handle 114, a leg pad 64 an arm starting region fixing unit 45, a set of weight stack 71, a moving mechanism 9 as a seat location fixing unit provided on the frame for moving the seat vertically c/d when seen above, a moving mechanism 8 for moving the seat laterally a/b is attached and shows a state to which a moving mechanism is attached according to an embodiment of the present invention and configured to move the seat laterally from the original existing location of the seat so that, a seat location fixing unit adjusts the seat to be parallel to the leg pad 64 and aligned to the leg pad when viewed from above, and the arm starting region fixing unit enable the user to lie down on his/her back placed on the seat, perform a motion for stretching his/her back straight from a starting pose at which the user places the leg pad above the pelvis, bends his/her knees to put feet on the ground, and bend his/her back to 90; or sit on the seat with both of the user's hip and thigh and perform leg extension exercises; or sit on the seat with both of the user's hip and thigh and perform leg curl exercises; or place left hip and thigh of the user on the seat and perform abduction exercise with the right leg of the user; or lie down on his/her back placed on the seat, perform a motion for stretching his/her back straight from a starting pose at which the user places the leg pad above the pelvis, bends his/her knees to put feet on the ground, and bend his/her back to 90 degrees.

Figure 13:
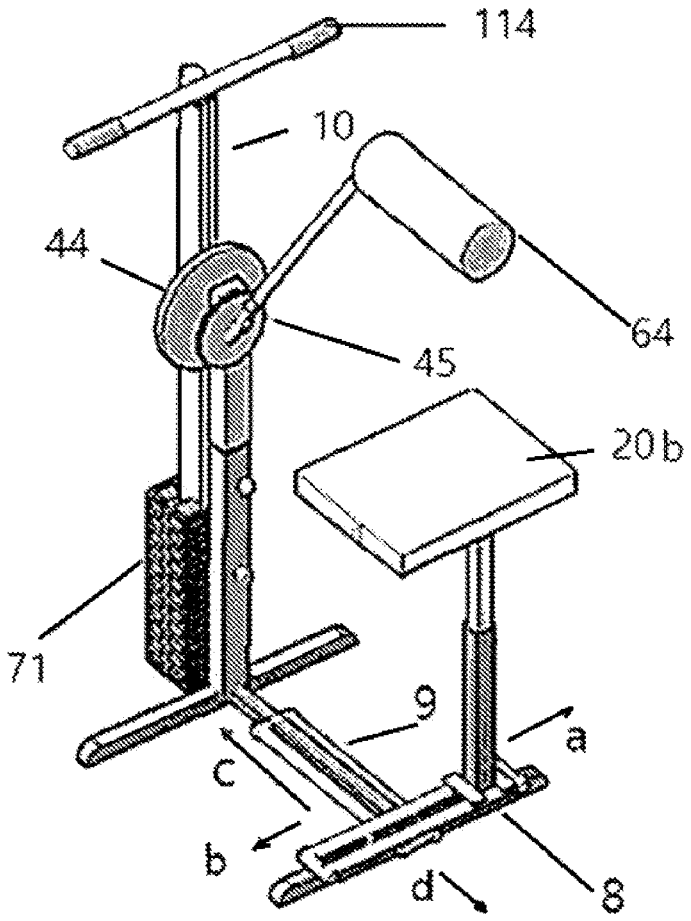
FIG. 13 is a diagram for describing the exercise device according to an embodiment of the present invention, to which the seat is attached to be separated from the leg pad when viewed from above, in order to perform an extension operation of the user's left leg when the user is sitting on the seat with the right leg and the right hip of the user.

FIG. 13 describes a state in which a handle 114, a frame 10, a seat 20, a seat height fixing unit 24, a handle 114, a leg pad 64, an arm starting region fixing unit 45, an arm axis 44, a set of weight stack 71, a moving mechanism 9 as a seat location fixing unit for moving the seat vertically c/d when seen above, a moving mechanism 8 for moving the seat laterally a/b are attached according to an embodiment of the present invention and shows a state to which a moving mechanism is attached and configured to move the seat vertically from the original existing location of the seat so that, a seat location fixing unit adjusts the seat to be parallel and aligned to the leg pad when viewed from above, and the arm starting region fixing unit enable the user to place a right hip and right thigh of the user on the seat, place the user's left leg on the leg pad, and move the left leg of the user backward from an exercise starting position where the leg is pulled toward the user's chest such that the user's leg moves during exercises and the user flexes the hip while exercising.

Figure 14:
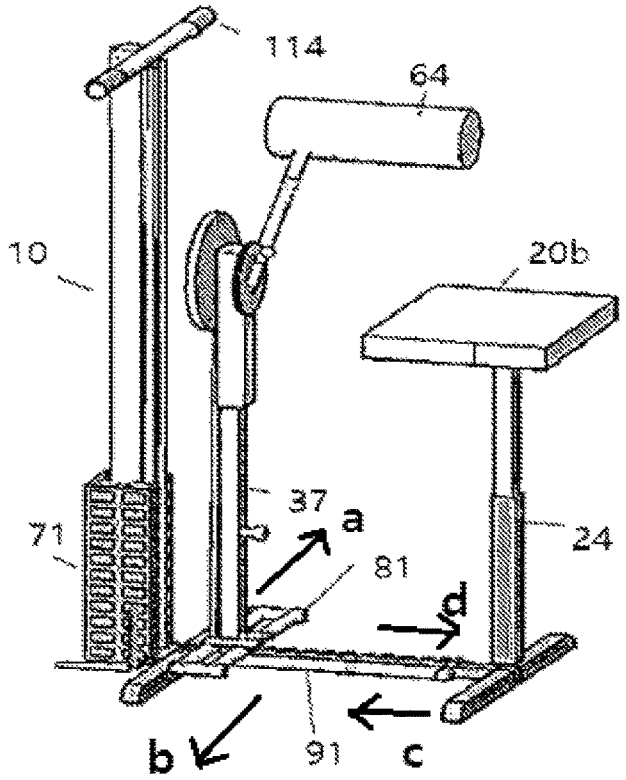
FIG. 14 is a diagram for describing the exercise device according to an embodiment of the present invention, to which the seat is attached to be separated from the leg pad when viewed from above, in order to perform an extension operation of the user's left leg when the user is sitting on the seat with the right leg and the right hip of the user.

FIG. 14 describes a state in which a handle 114, a frame 10, a seat 20, a handle 114, a leg pad 64, a set of weight stack 71, a moving mechanism 91 as an arm axis location fixing unit provided on the frame for moving the seat vertically c/d when seen above, a moving mechanism 81 for moving the seat laterally a/b are attached and shows a state to which a moving mechanism are attached according to an embodiment of the present invention and configured to move the arm fixing unit vertically from the original existing location of the arm so that, an arm location fixing unit adjusts the range of motion of the leg pad to be separated with the seat when viewed from a sagittal plane, and the arm starting region fixing unit and the arm location fixing unit enable the user to place a right hip and right thigh of the user on the seat, place the user's left leg on the leg pad, and move the left leg of the user backward from an exercise starting position where the leg is pulled toward the user's chest such that the user's leg moves during exercises and the user flexes the hip while exercising.

Figure 15:
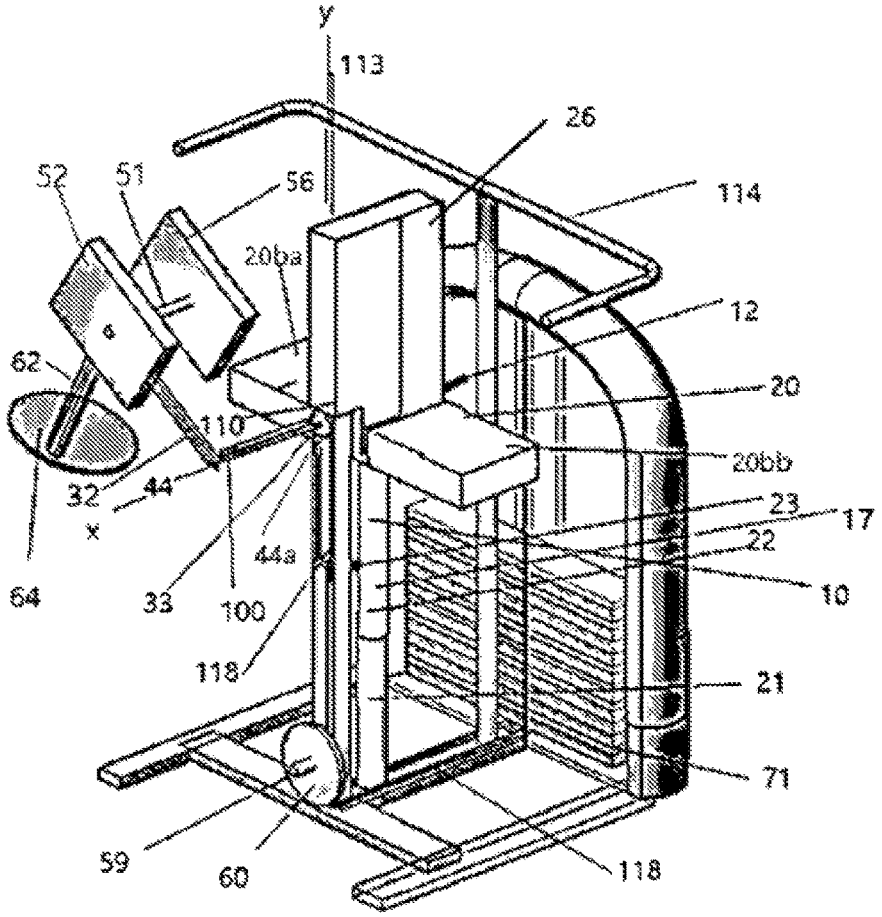
FIG. 15 is a diagram for describing the exercise device according to an embodiment of the present invention, to which the seat is seat is attached to be separated from the leg pad when the arm is rotated to be in the center and viewed from above, and it is adjusted to perform an extension and abduction operation of the user's left leg when the user is sitting on the seat with the right leg and the right hip of the user.

FIG. 15, describes a state in which a seat for the right hip and the right thigh of the user, 20*bb* for the left hip and the left thigh of the user, a seat handle 12, a handle 114, a frame 10, a seat 20, an arm 32, an arm axis 44, a seat height fixing unit 24, a cross strut of the frame 14, a leg pad 64, a handle 114, a seat height fixing pin 23, a seat casing 22, a seat base 21 for adjusting the seat height, an arm connector 33 for connecting the arm to the frame, a set of weight stack 71, a weight disk 60, a weight disk holder 59, a leg pad connector 62 for connecting the leg pad and the arm, two pads 52, a torso support 26, pad connector 51 for connecting the leg connecter and the pad 52, and shows a state to which a two axes mechanism 44*a* that enable a pivot axis of the arm portion to be rotatable about both a y-axis perpendicular to the ground and an x-axis parallel to the ground so that the user performs a rotation activity about both the x-axis and the y-axis are attached. It shows a state which allows the user to sit on the seat with right hip and right thigh of the user that is not exercising, locate left foot of the user on the leg pad, and move the left leg backward and spread apart from an exercise starting position where the left leg is pulled toward the user's chest and put together when viewed from above.

FIG. 16, describes a state in which a seat for the right hip and the right thigh of the user, 20*bb* for the left hip and the left thigh of the user and the 20*ba* and 20*bb* can be used to support the back of the user when the user is in a lying position, a seat handle 12, a handle 114, a frame 10, a seat 20, an arm 32, an arm axis 44, a leg pad 64, a handle 114, two pads 52, a weight disk 60, a weight disk holder 59, are attached according to an embodiment of the present invention and shows a state to which a two axes mechanism 44*a* that enable a pivot axis of the arm portion to be rotatable about both a y-axis perpendicular to the ground and an x-axis parallel to the ground so that it allows the user to lie on the seat with left hip and left thigh of the user that is not exercising, locate right thigh of the user on the leg pad, and move the right leg backward and spread apart from an exercise starting position where the right leg is pulled toward the user's chest and put together.

Figure 17:
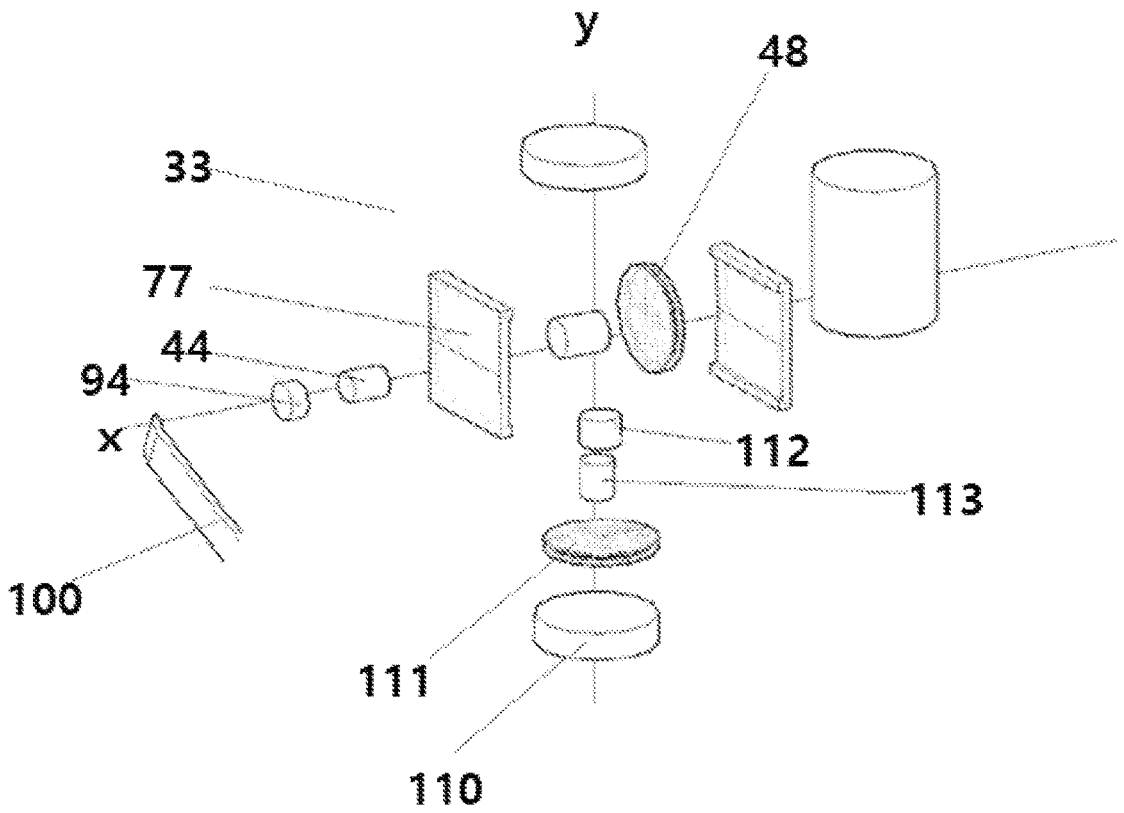
FIG. 17 is a partial view illustrating a two axes mechanism 44*a* of FIG. 16 which is provided on the arm and the arm is rotatable about both the x-axis (parallel to the ground) and the y-axis (perpendicular to the ground) according to the present disclosure.

FIG. 17 describes partial view illustrating a two axes mechanism 44*a* of FIG. 17 which is provided on the arm 32 and the arm is rotatable about both the x-axis (parallel to the ground) and the y-axis (perpendicular to the ground) according to the present disclosure. It describes a state in which the roller base 77 (referred to as 'first roller base 77') configured to support rotation of the roller 48 (referred to as 'first roller 48') about an x-axis parallel to the ground includes a second roller 111 perpendicularly intersecting the first roller base 77 and configured to rotate about a second arm pivot axis 113 parallel to a y-axis perpendicular to the ground, a second bearing 112 configured to support rotation of the second roller 111, a bearing 94 having a horizontal cylindrical shape and located on a central portion of a side surface of the pivot axis 44 of the arm portion, are attached according to an embodiment of the present invention.

FIG. 18 shows an exploded perspective view of the two axis mechanism 44*a* of FIG. 18 and describes a state in which the roller base 77 (referred to as 'first roller base 77') configured to support rotation of the roller 48 (referred to as 'first roller 48') about an x-axis parallel to the ground includes a second roller 111 perpendicularly intersecting the first roller base 77 and configured to rotate about a second arm pivot axis 113 parallel to a y-axis perpendicular to the ground, a second bearing 112 configured to support rotation of the second roller 111, and a second roller base 110 provided on an end of the first roller base 77, a bearing 94 having a horizontal cylindrical shape and located on a central portion of a side surface of the pivot axis 44 of the arm portion, and configured to support rotation of the second roller 111 are attached according to an embodiment of the present invention.

The exercise device according to an embodiment of the present invention preferably includes: an arm 32 pivotably connected to the frame 10 and rotatable wherein the arm comprises an arm pivot axis 44 aligned with a user's hip joint; a leg pad 64 pivotably connected to a lower end of the arm and configured to contact the user's leg during use, a handle connected to a lower end of the seat or to the frame and extending therefrom 114; an arm starting region fixing unit 45 which is provided to fix an exercise starting section; an arm length fixing unit 52 for adjusting the length of the arm; a seat 20 which is configured in correspondence to a hip and a thigh of a leg of two legs of a user so as to support the hip and the thigh of the leg that is not exercising and not to support the hip nor the thigh of the other leg of the user, and thus the seat 20 is separated from the leg pad 64 when viewed from above 20*b*. In addition, as shown in FIGS. 3 through 17, the arm may comprise a pivot axis on rear end of the seat, aligned with a user's hip joint, within a radius of 20 cm from the user's pelvis when viewed in a sagittal plane.

The device is configured to enable the exercising leg of the user to move to the back of the user from a starting pose at which the hip and the thigh of the leg that is not exercising is placed on the seat 20 and the exercising leg is placed on the leg pad 64 and pulled to the chest of the user. Preferably, a leg pad may be configured to contact the user's thigh during use to protect the user's knee and ankle joints while exercising the thigh and gluteal muscles. In addition, a torso support 26 may be located in front of or behind the seat and a torso support angle adjustment may be configured to support the user in lying position. Also, as shown in FIGS. 15, 16, a seat 20 (20*ba* or 20*bb*) can be used to support the back of the user when the user is in a lying position and a seat handle 12 may be provided as shown in FIGS. 7, 9, 15.

Selectively, as shown in FIGS. 15, 16, a seat for the right hip and the right thigh of the user 20*ba* and a seat for the left hip and the left thigh of the user 20*bb* can be provided and the 20*ba* and 20*bb* can be used to support the back of the user when the user is in a lying position. In addition, an arm starting region fixing unit 45 can be provided on the arm to fix an exercise starting section to the left when a user exercises the left leg and fix the exercise starting section to the right when the user exercises the right leg, and thus the user may adjust the exercise starting section according to his/her purpose.

An exercise device according to an embodiment of the present invention may further include a seat angle fixing unit 116 for adjusting the angle between the seat 20 and the leg pad 64, so that, when the seat angle fixing unit 116 adjusts the leg pad 64 and the seat 20 to be parallel to each other when viewed from above 20*a*, as shown in FIG. 10, the seat angle fixing unit 116 enables moving legs of a user to abduct, adduce, or gather and spread while the user is seating, or lying down on the seat 20 and placing a thigh and a hip of a leg of two legs of the user on the leg pad 64. Also, when the seat angle fixing unit 116 adjusts the leg pad 64 and the seat 20 to be perpendicular to each other when viewed from above 20*b*, as shown in FIG. 5, 7, 8, 9, the seat angle fixing unit 116 enables the user to place a leg of two legs of the user on the leg pad 64 and lower the leg and kick back from a starting pose at which the thighs are pulled toward the chest of the user, while the thigh and the hip of the other leg of the user are on the seat 20.

The seat angle fixing unit 116 may include a fixing screw 35, a roller provided at one end of the seat strut of the frame 13 which is connected to the seat 20, a roller base 34 connected to a cross strut of the frame 14. When a user tries to extend and lower the right leg and kick down, as shown in FIG. 7, 8, 9, the roller is rotated to place the seat 20 in correspondence to the left thigh and left hip of the user and the seat 20 is fixed by using the fixing screw, such that the user may lower the right leg and kick back from a starting pose at which the user places the left leg on the seat and pulls the right leg toward the chest while seating, or lying down on his/her back.

In addition, as shown in FIG. 11, when the arm starting region fixing unit 45 fix the arm relatively low, and the seat angle fixing unit 116 adjusted the seat 20 and the leg pad 64 to be parallel to each other when viewed from above 20*a*, while a user is lying down on his/her back placed on the seat 20, the user may additionally perform a motion for stretching his/her back straight from a starting pose at which the user places the leg pad 64 above the pelvis, bends his/her knees to put feet on the ground, and bend his/her back to 90 degrees (hip bridge exercise).

Also, as shown in FIG. 9, a seat height adjusting unit 24 provided on the frame, an arm length fixing unit 52, an arm axis height adjusting unit 115 may be provided on the frame to adjust the height of the seat or the height of the arm axis relatively low, such that, they make it convenient for the user to lie down on his/her back placed on the seat 20, perform a motion for stretching his/her back straight from a starting pose at which the user places leg pad 64 above the pelvis, bends his/her knees to put feet on the ground, and bend his/her back to 90 degrees.

Meanwhile, when the arm starting region fixing unit 45 fix the arm to be relatively low, and the seat angle fixing unit 116 adjusted the seat 20 and the leg pad 64 to be parallel to each other when viewed from above, as shown in FIG. 11, the user may additionally perform a motion for stretching his/her knees straight from a starting pose at which the user places both of the user's leg on the seat 20 and put the leg pad 64 above the lower legs, bends his/her knees, and stretch his/her knees (leg extension exercise). Also, when the arm starting region fixing unit 45 fix the arm parallel to the ground, and the seat angle fixing unit 116 adjusted the seat 20 and the leg pad 64 to be parallel to each other when viewed from above, as shown in FIG. 11, the user may additionally perform a motion for curling his/her knees from a starting pose at which the user places both of the user's leg on the seat 20 and put the leg pad 64 under the lower legs, stretch his/her knees, and curl his/her knees (leg curl exercise).

Selectively, as shown in FIG. 8, a seat angle fixing unit 116 may be provided to adjust the angle between the seat 20 and the frame 10 on the user's purpose.

An exercise device according to an embodiment of the present invention may further include a seat location fixing unit for adjusting the location of the seat. The seat location fixing unit may comprise a moving mechanism 8/9, the moving mechanism 9 move the seat vertically c from the original existing location of the seat so that, when the seat location fixing unit adjusts the seat 20 to be aligned to the leg pad 64 when viewed from above 20*a*, as shown in FIG. 12, the moving mechanism and the arm starting region fixing unit 45 enable the user to lie down on his/her back placed on the seat, perform a motion for stretching his/her back straight from a starting pose at which the user places the leg pad above the pelvis, bends his/her knees to put feet on the ground, and bend his/her back to 90; additionally perform a motion for stretching his/her knees straight from a starting pose at which the user places both of the user's leg on the seat 20 and put the leg pad 64 above the lower legs, bends his/her knees, and stretch his/her knees; also, the user may additionally perform a motion for curling his/her knees from a starting pose at which the user places both of the user's leg on the seat 20 and put the leg pad 64 under the lower legs, stretch his/her knees and curl his/her knees.

The moving mechanism 9 may also move the seat vertically to the space of the original existing location of the seat so that, the seat location fixing unit adjusts the seat to be separated from the leg pad 64 when viewed from above, the seat angle fixing unit and the arm starting region fixing unit enable the user's exercising leg to move to the back of the user from a starting pose at which the hip and the thigh of the leg that is not exercising is placed on the seat and the exercising leg is placed on the leg pad and pulled to the chest of the user.

The seat location fixing unit may also include a moving mechanism 8 that may move the seat laterally b from the original existing location of the seat so that, as shown in FIG. 12, the moving mechanism 8 and the arm starting region fixing unit 45 make it convenient for the user to lie down on his/her back placed on the seat, and perform a motion for stretching his/her back straight from a starting pose at which the user places the leg pad above the pelvis, bends his/her knees to put feet on the ground, and bend his/her back to 90; additionally perform a motion for stretching his/her knees straight from a starting pose at which the user places both of the user's leg on the seat 20 and put the leg pad 64 above the lower legs, bends his/her knees, and stretch his/her knees; also, perform a motion for curling his/her knees from a starting pose at which the user places both of the user's leg on the seat 20 and put the leg pad 64 under the lower legs, stretch his/her knees, and curl his/her knees.

In addition, a leg pad connector 62 may be provided to connect the leg pad and the arm 32. Also, as shown in FIGS. 15, 16, the arm may be provided with a pad or two pads or "H" shaped pad to contact the thigh of the user when the user abduct, adduce, or gather and spread while the user is seating, or lying down on the seat 20 and placing the thigh and the hip of the leg of two legs of the user on the leg pad 64.

As shown in FIGS. 10, 11, and 15, the seat 20 may further include pads on both side surfaces of the seat in correspondence to both sides of thighs of a user. As shown in FIG. 10, when the user tries to adduce or gather the left leg, the user uses a pad provided on the left side of the seat in correspondence to the thigh of the user. When the user tries to abduct or spread the left leg, the user uses a pad provided on the right side of the seat in correspondence to the thigh of the user.

As shown in FIG. 10, when the user tries to adduce or gather the right leg, the user uses a pad provided on the left side of the seat in correspondence to the thigh of the user. When the user tries to abduct or gather the right leg, the user uses a pad provided on the left side of the seat in correspondence to the thigh of the user. Also, as shown in FIG. 11, pads at both sides of the seat in correspondence to both sides of a user's thighs may be foldably arranged.

Selectively, the frame may include a cross strut 14, a seat strut 13, a handle strut 10*a*, an arm strut 10*b*, and a resistive force strut 10*c*. So the arm 32 may be connected to the handle strut of the frame (FIGS. 8, 9, 10, 11), the seat strut of the frame (FIGS. 4, 5, 6, 7, 15), the resistive force strut of the frame (FIG. 3), or the arm strut of the frame (FIGS. 12, 13, 14, and 16).

Selectively, the exercise device according to an embodiment of the present disclosure may include a two axes mechanism 44*a* provided on the frame, that enable a pivot axis of the arm portion to be rotatable about both a y-axis perpendicular to the ground and an x-axis parallel to the ground so that the user performs a rotation activity about both the x-axis and the y-axis, so that, the two axes mechanism 44*a* provided on the frame allow the user to sit or lie on the seat with a hip and a thigh of two legs of the user, locate the other leg of the two legs of the user on the leg pad, and move the leg which is on the leg pad backward and rotate the leg rightward or vice versa; or spread the leg apart or put together, from an exercise starting position where the exercising leg is pulled toward the user's chest and put together or spread apart while the other leg of the user is on the seat.

The exercise device according to an embodiment of the present disclosure may include a resistive force generator configured to generate a resistive force when the arm portion 32 pivots and a connector may be configured to connect the resistive force generator to the frame 10. For example, as shown in FIGS. 7, 8, and 10 through 15, the resistive force generator may include the load block 71. In order to generate resistance against rotation of the arm portion, the load block 71 is connected to the arm connector 33, which includes a rotation roller that rotates around the rotation shaft 44 and a roller base supporting and surrounding the roller, via a wire. Also, as shown in FIG. 15, the resistive force generator may include the weight disk 60 or an elastic band 75 (FIG. 5). In addition, a two axes mechanism 44*a* that enable a pivot axis of the arm portion to be rotatable about both a y-axis perpendicular to the ground and an x-axis parallel to the ground may comprise two resistive force generator configured to generate the resistive force against each pivoting axes of the arm.

Figure 20:
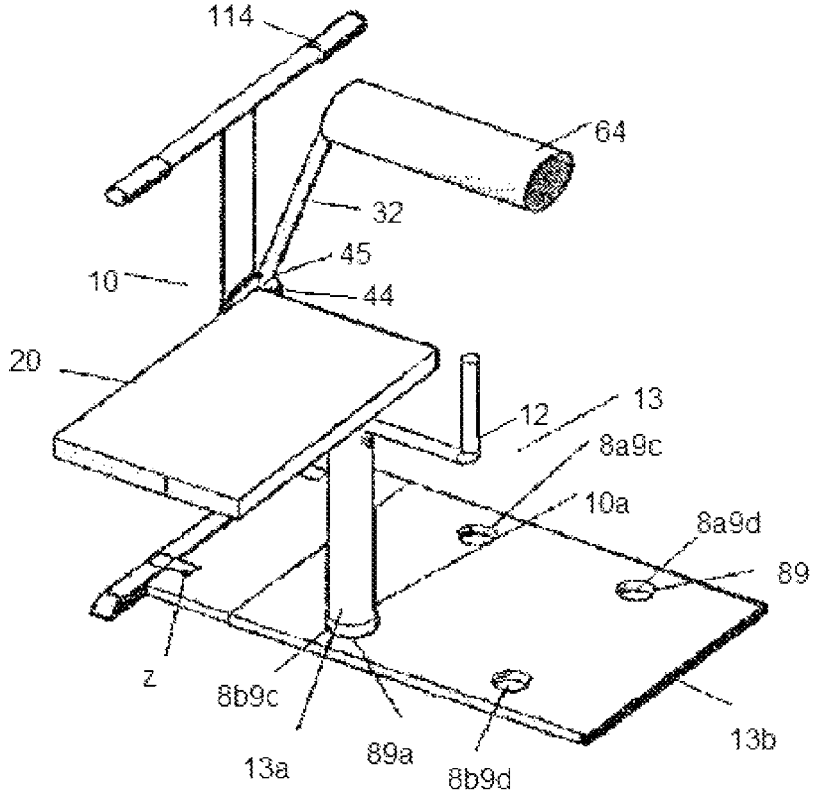
FIG. 20 is a diagram for describing the exercise device according to an embodiment of the present invention, the diagram showing a state in which the seat is adjusted to be unseparated from the leg pad when viewed from above, in order to lie down on his/her back placed on the seat, perform a motion for stretching his/her back straight from a starting pose at which the user places the leg pad above the pelvis; or perform stretching his/her knees from starting position where the thighs and hips are on the seat and knees are bend to 90 degrees; or curling his/her knees motion from starting position where the thighs and hips are on the seat and knees are stretched and the leg pad is on his/her back of the lower legs.
Figure 21:
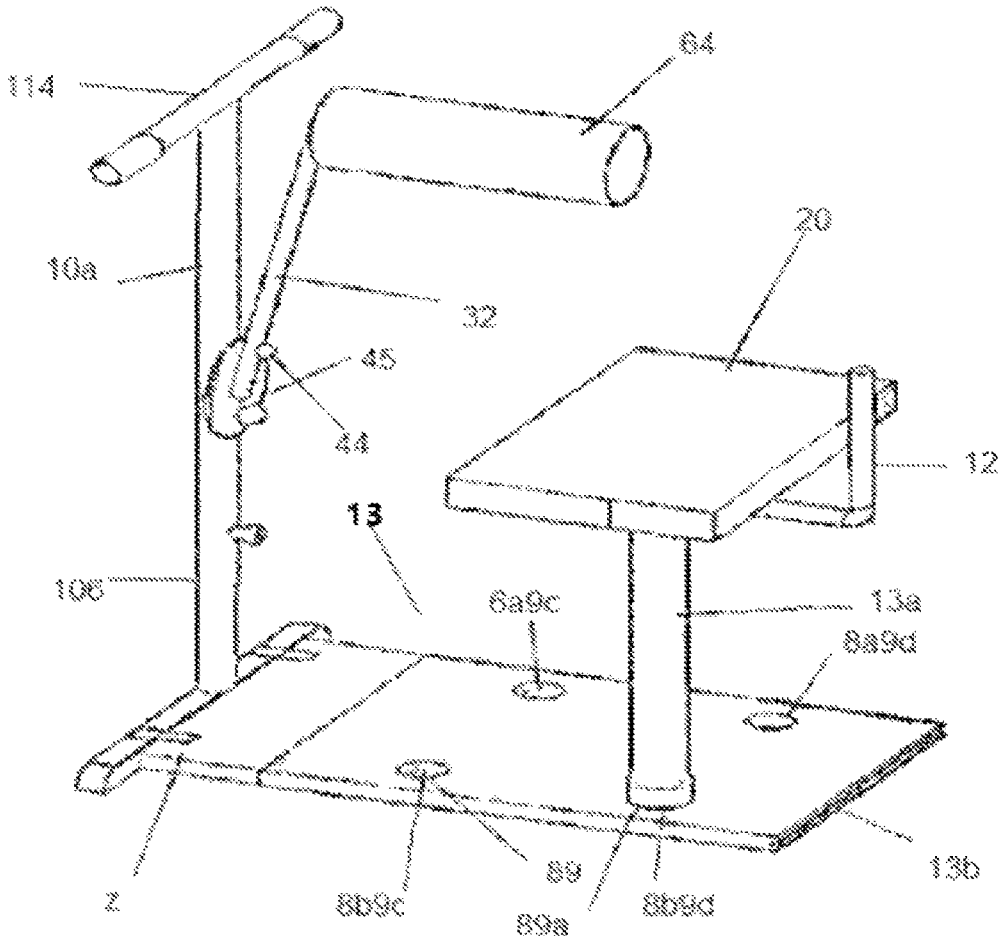
FIG. 21 is a diagram for describing the exercise device according to an embodiment of the present invention, to which the seat is attached to be separated from the leg pad when viewed from above, in order to perform an extension operation of the user's left leg when the user is sitting on the seat with the right leg and the right hip of the user.

FIGS. 19, 20, 21 show the exercise device according to an embodiment of the present disclosure in which the frame comprises an arm strut b and a seat strut 13; further comprising a seat location fixing unit 13*z* on the seat strut 13, for adjusting the location of the seat. The seat strut 13 is composed of a seat location fixing rod 13*a* and seat location fixing places 13*b*. The seat location fixing place 13*b* may compose several holes 89 for the user to choose to adjust (put) the said seat location fixing rod 89*a* according to the his/her purpose. The frame comprises an arm strut and a seat strut and further comprises an arm axis location fixing unit on the arm strut for adjusting the location of the arm axis.

The invention claimed is:

1. A device for exercising upper leg portions, the exercise device comprising:

a frame having a ground strut and a handlebar extending from a first end of the ground strut to be held by a user for postural stability;

an arm pivotably connected to the frame and rotatable about an axis at a first end of said arm;

a leg pad having a long axis and pivotably connected to a second end of the arm and configured to contact the user's leg and rotate about said axis during use;

a seat angle fixing unit extending from a second end of the ground strut;

an elongated rectangular seat having long axis, said seat connected to the seat angle fixing unit in an off-center configuration and configured to support a user in a sitting or lying position;

wherein seat angle fixing unit, is configured to adjust the seat vertically and rotatably such that the long axis of the seat may be arranged perpendicular to the long axis of leg pad when viewed from above, such that the seat is configured to correspond to a hip and a thigh of a leg of two legs of the user so as to support the thigh and the hip that are not exercising and not to support the other thigh nor the other hip of the user, and thus the seat is separated from the leg pad when viewed from above, and the seat is configured not to press the leg nor the hip of the leg that is exercising when the user performs a motion for moving the exercising leg to the back of the user from a starting pose at which the thigh and the hip of the leg that is not exercising are placed on the seat and the other leg of the user is placed on the leg pad, and the user is capable of moving his/her exercising leg to the back of the user from a starting pose at which the user places the exercising leg on the leg pad and pulls the thigh toward the chest while the thigh and hip of the other leg are on the seat;

wherein via the said seat angle fixing unit, the seat can also be rotated about a vertical axis of the seat angle fixing unit such that a short axis of the seat may be arranged parallel to the leg pad when viewed from above, such that the seat is configured to correspond to a back of the user so that the user is allowed to perform a motion for stretching their back straight from a starting pose at which the user lie down on their back placed on the seat, wherein the leg pad is placed above a user's pelvis.

2. An upper leg and hip exercise method by using an exercise device, the said device comprising:

a frame having a ground strut and a handlebar extending from a first end of the ground strut to be held by a user for postural stability;

an arm pivotably connected to the frame and rotatable about an axis at a first end of said arm;

a leg pad having a long axis pivotably connected to a second end of the arm and configured to contact the user's leg and rotate about the said axis during use;

a seat angle fixing unit on extending from a second end of the ground strut;

an elongated rectangular seat having a long axis, said seat connected to the seat angle fixing unit in an off-center configuration and configured to support a user in a sitting or lying position;

wherein said seat angle fixing unit is configured to adjust the angle between the seat and the long axis of the leg pad, when viewed above, said seat angle fixing unit is configured for the user to choose the angle between the seat and leg pad so that the seat can be rotatably adjusted about a vertical axis of the seat angle fixing unit, so that the seat is configured to correspond to a hip and a thigh of a leg of two legs of the user so as to support the thigh and the hip that are not exercising and not to support the other thigh nor the other hip of the user, and thus the seat is separated from the leg pad when viewed from above, and the seat is configured not to press the leg nor the hip of the leg that is exercising, wherein the user performs a motion for moving the exercising leg to the back of the user from a starting pose at which the thigh and the hip of the leg that is not exercising are placed on the seat and the other leg of the user is placed on the leg pad, and the user move their exercising leg to the back of the user from a starting pose at which the user places the exercising leg on the leg pad and pulls the thigh toward the chest while the thigh and hip of the other leg are on the seat;

wherein by using said seat angle fixing unit, the seat also can be adjusted to be parallel to the long axis of the leg pad when viewed from above that the seat is configured in correspondence to a back of the user, wherein the user performs a motion for stretching their back straight from a starting pose at which the user lies down on with their back placed on the seat, wherein the leg pad is placed above a user's pelvis.

* * * * *